United States Patent [19]

Terrase

[11] 4,409,081

[45] Oct. 11, 1983

[54] SACRIFICIAL ANODE

[76] Inventor: Leon J. Terrase, 6000 Brighton Pl., Algiers, La. 70114

[21] Appl. No.: 346,263

[22] Filed: Feb. 5, 1982

[51] Int. Cl.[3] ..... C23F 13/00

[52] U.S. Cl. ..... 204/197; 204/286; 204/297 R

[58] Field of Search ..... 204/148, 197, 286, 297 R

[56] References Cited

U.S. PATENT DOCUMENTS 3,870,615 3/1975 Wilson et al. ..... 204/197
4,176,033 11/1979 Council ..... 204/197

FOREIGN PATENT DOCUMENTS 719427 12/1954 United Kingdom ..... 204/197
852154 10/1960 United Kingdom ..... 204/197

*Primary Examiner*—T. Jung
*Attorney, Agent, or Firm*—Calvin J. Laiche

[57] ABSTRACT

The present invention provides an anode assembly for use on marine structures comprising an elongated sacrificial anode bar and an anode core comprising an elongated member having a straight portion embedded within the anode bar means and its end portion being mitred and which protrude from the side of the anode bar means away from the ends thereof.

Preferred embodiments are directed to cores having particularly preferred mitred angles, as well as the cross-sectional configuration of the anode.

3 Claims, 2 Drawing Figures

SACRIFICIAL ANODE

BACKGROUND OF THE INVENTION

The present invention is concerned with retardation of metallic corrosion. More specifically, the present invention is concerned with cathodic protection as a means of minimizing metallic corrosion.

Corrosion is a form of chemical or electrical attack on a material by another medium. In the case of metals, the most destructive type of corrosion results from electrochemical or galvanic attack, often thought of as being chemical in nature.

The present invention is concerned with the retardation of galvanic corrosion by cathodic protection which is generally defined as the reduction or elimination of corrosion by making the metal cathode by means of an impressed D.C. current or attachment to a sacrificial anode. The instant invention is particularly concerned with applying this technology to the protection of offshore platforms against the surrounding salt water environment. Protection to such structures is generally provided by attaching sacrificial anodes to the structure at various point, the structure being made the cathode. Such anodes generally consist of zinc, magnesium, and/or aluminum alloys. These metals are electrochemically reactive with the salt water which acts as the electrolyte whereby these sacrificial materials are gradually consumed in lieu of the structure itself being severaly attacked. Typical of such artificial anodes is that as described in U.S. Pat. No. 3,870,615.

The use of cathodic protection aboard offshore oil platforms presents especially unique problems in the corrosion arts today. Needless to say, unless these anodes are installed initially on the superstructure of a platform before it is transported to location and set into place, the cost of installing them at sea is quite expensive. For such installations, it is necessary to provide specially designed equipment in the form of boats, suspension equipment, and the like. Additionally, it is necessary to employ divers to install such equipment. For that reason, it is quite common to design the life span of such cathodic systems to last at least 10 years, and in some instances, such systems are now being designed with a life span of 20 years, such as in the case of deep water structures due to the much greater economic investment therein. For these and other reasons, it is imperative that such systems be well designed as the cost of repairing and maintaining the same is likewise very costly.

Diverse types of anode structures and methods of attaching them to a platform superstructure have been devised. These different means of attachment involve themselves both with the means of attaching the anodes to its supporting structure, as well as the means for attaching the anode supporting structure to the platform structure. Poor connection between the anodes and the platform structure can result in many common problems, such as; the anode becoming displaced or disattached from the structure due to initial mechanical shock during the placement of the platform, e.g., specifically during the pile driving process, or due to ordinary stresses during operation of the platform, e.g., wave action; poor electrical contract between the anode and a platform; or the like.

There are four basic types of anode supporting structures designed for attachment to an oil platform superstructure which generally comprise a series of structurally related pipes or cassons welded together. The band or saddle type of clamp was one of the first attachment designs employed in the art. However, it takes fairly long to install because it fits over a wide area which if need be cleaned, naturally takes a long time under water. Moreover, it has been found that corrosion takes place under the clamp, as well as the possible growth of marien growth underneath the clamp whereby electrical contact can be broken with the structure. Typical of such types of anode clamp assemblies is that as disclosed in U.S. Pat. Nos. 3,803,012 and 4,176,033.

Another type of anode attachment means employed has been a chain type of clamp. While these clamps are generally easier to install, they have been found to become loose because a twist in the chain initially sometimes subsequently leaves the clamp loosely attached.

Many of the above prior art type of anode structures not only suffer disadvantages in their specific manner of attaching them to a platform structure, but additionally there are many problems in the art concerned with the manner of attaching the particular sacrificial anode material itself to the attachment superstructure so as to insure a tight intrical connection.

The thrust in the art today has been toward welding the anode assembly to the superstructure. Needless to say, when the anodes are welded to the superstructure prior to its submersion, then the inherent problems in securing an integral weld is greatly minimized, however, in the replacement of existing anode assemblies aboard operating superstructures, it is mandatory that they be welded thereto under water. Such conditions naturally makes it difficult for a welder to achieve an integral weld. The absence of an integral weld will not only result in the anode assembly from being jarred lose from the superstructure due to mechanical abuse, but perhaps even more important from realizing a sound electrical connection between the anode core and the superstructure.

Various improvements have been made in the arts to overcome the problems associated with the welding of anode cores together and/or to their supporting superstructure. For example, reference is made to the above referred to U.S. Pat. No. 3,870,615 wherein the prior art problems connected with particular design of anode cores are discussed. As brought out in the patent, the use of mitred joints employed in the supporting anode structure as shown in FIG. 4 of that patent have not proven trustworthy due to mechanical failures which have resulted from the physical shock, stresses, and forces of the sea to which such sacrificial anode structures are normally subjected. That patent teaches the use of an integral anode core welded at right angles to the supporting superstructure. Of course, the type of mitred joints referred to are those structurally resembling the anode attachment design of that patent, viz., 90° arcuate sections at each opposite end of the straight elongated anode central section. A particular serious problem with the anode core design of that patent as regards to such anode structures when positioned parallel to and upon a vertical or battered jacket leg or platform support member is that during the pile driving process of installing the platform, the anode structure is subjected to a shearing force or stress generally at the point of juncture where the anode core is attached to the structure. To prevent the resultant failure of the anode attachment, it is common practice to employ a doubler plate at the point of attachment to the structure, and also, to reinforce that attachment with gusset plates. Such practice has resulted in merely shifting the point of failure from the point of attachment of the anode to the point of interface where the anode core exits from the anode. The present invention offers a different anode supporting core design which readily overcomes the stated prior art problems enumerated in U.S. Pat. No. 3,870,615, and which additionally offers certain distinct advantages and features over the design of that patent as well.

Among the many advantages and features of the present invention is that not only superior electrical connections between the core and its superstructure are realized, as well as eliminating the problems of mechanical failure as referred to in U.S. Pat. No. 3,870,615, but additionally achieves a very favorable electrical conductive system which produces a more desirable consumption pattern of the anode thus prolonging the life of the present anode. These and other features and advantages of the instant invention will become apparent to one skilled in the art in light of the details of construction and operation of the present sacrificial anode as shown in the drawing as described in the ensuing detailed disclosure of its preferred embodiments which is particularly pointed out in the appended claims.

DESCRIPTION OF THE DRAWING

For a better understanding of the nature and objects of the invention, reference should be had to the following drawing, taken in conjunction with the detailed description thereof. In the drawing, synonomous reference numerals are employed throughout in the various views to refer to identical components.

DESCRIPTION OF THE PREFERRED EMBODIMENT(S)

Figure 1:
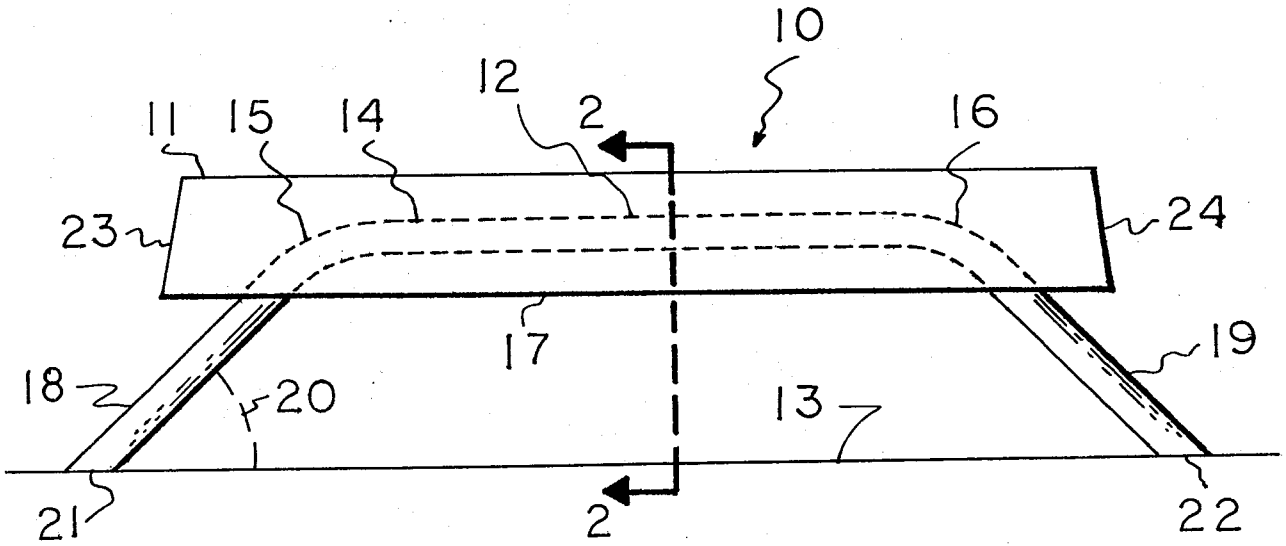
FIG. 1 of the drawing represents a side elevational view showing the present sacrificial anode means as installed.

Referring to FIG. 1 of the drawing, the present sacrificial anode means 10 comprises the sacrificial anode material or member 11, generally an aluminum alloy, or some other suitable anodic material comprising zinc, magnesium, or the like, is initially cast upon the supporting pipe core member 12. This structure is achieved in various well known conventional techniques employed in the art initially in the shop and subsequently the assembly is welded to the supporting superstructure 13 which as shown in FIG. 2 of the drawing constitutes a pipe or casing of which many conventional offshore structures are fabricated.

The core member 12 preferably comprises conventional pipe which can be of whatever size and wall thickness desired. The pipe size naturally varies depending upon the desired weight of anode and its particular application, however, generally pipe sizes from 2.37" O.D. through 6.625" O.D. are sufficient. Likewise, the net weight of the anode member 11 will vary depending upon the application, however, anywhere from about 250# to 1,250# are employed. The application further diictates the particular overall anode dimension also. Of course, other suitable materials of construction for the core 12 can be employed as long as it produces the specific results desired and which are inherent in the present invention.

As also shown in FIG. 1 of the drawing, the supporting core member 12 comprises the elongated straight portion 14 which is embedded essentially in the center of the anode member 11. The end portions 15 and 16 of the core member 12 are bent such that they exit from the side 17 of the anode member 11. The bent portions 15 and 16 are bent to the extent that the connecting ends 18 and 19 contact the supporting superstructure 13 such that the included angle 20 will from around 30° to 60° depending upon the particular application, as well as the particular cross-sectional configuration of the core member 12 which is preferably conventional schedule 40, 80, 120, or 160 pipe whereby the bending radius thereof will vary preferably according to the particular diameter and wall thickness of the pipe core employed.

Figure 2:
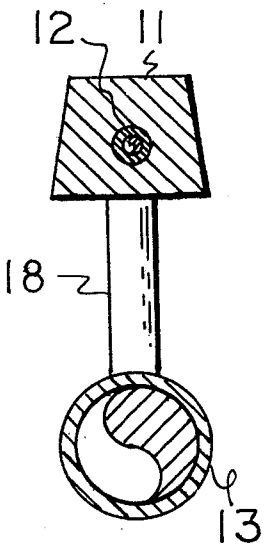
FIG. 2 of the drawing represents a cross-sectional view taken along the line 2—2 of FIG. 1.
Figure 1:
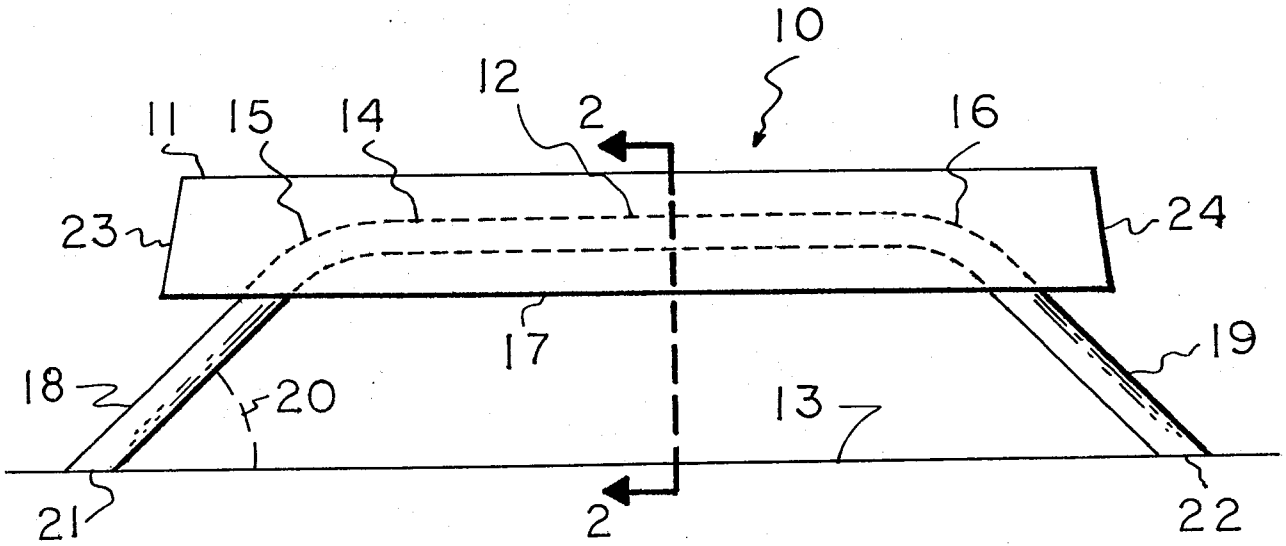
Figure 2:
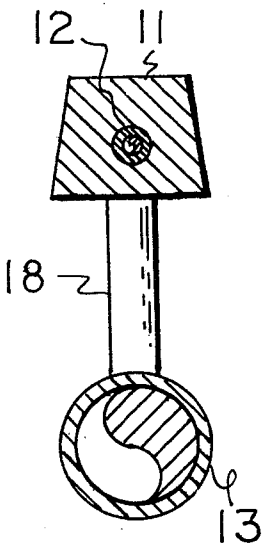

As further shown in FIG. 1 of the drawing, the ends 21 and 22 of the pipe core 12 are naturally also mitred in order to accommodate to fit flush upon the supporting pipe or casing 13, see also FIG. 2 of the drawing. Mitring the ends 21 and 22 insures a greater rigid and extensive contact between the end 18 and 19 of the core 12 as the mitred cross-section thereof produces a greater cross sectional area, whereby when the ends 21 and 22 are welded to the superstructure 13, additional weld material is used. This not only insures a much greater strength relationship between the members, but additionally provides considerable more electrical contact between the members which is one of the serious problems of the prior art. It has been found that where the extent of electrical contact between the anode support and the supporting superstructure is poor, then the anode material does not properly perform its intended purpose. Thus, it is crucial that not only for good mechanical support reasons that the anode core be properly attached to the superstructure, but additionally and but perhaps even more important, for proper electrical contact. Among the distinct advantages and features of the present invention is that by mitring the ends 18 and 19 for attachment to the superstructure 13, not only is a superior mechanical structure realized, but additionally, a much superior electrical contact is realized, together with the other advantages of having the ends 18 and 19 of the core 12 protrude from the side 17 of the anode 11. While not wishing to be bound by theory, it appears that this particular structural relationship results in a certain electrical conductive system which it has been found in the field produces a much more desirable consumption pattern of the anode 11 as compared to the prior art design. Further, it has been found that in the prior art design such as disclosed in U.S. Pat. No. 3,870,615, where the ends of the anode support member protrude or are located at the terminal ends of the anode itself, it has been found that the anode end is readily consumed at that point of juncture whereby the supporting end of the anode core is rapidly uncovered and exposed to the surrounding environment. On the other hand, in the preferred design of the present invention as shown in FIG. 1, the terminal ends 23 and 24 of the anode member 11 overhang the support arms 18 and 19. This particular preferred structural design does in fact offer a distinguishing advantage over typical prior art structures by producing this more desirable consumption pattern. Moreover, by casting the anode member 11 upon the mitred pipe core 12 in the manner shown, even should the anode become loose, it is prevented from sliding along the pipe due to the mitred bends 15 and 16. Thus, this particular structure shown in FIG. 1 of the drawing also provides a